US006010813A

United States Patent [19]

Endo et al.

[11] Patent Number: 6,010,813

[45] Date of Patent: Jan. 4, 2000

[54] TONER AND DEVELOPERS FOR DEVELOPING STATIC LATENT IMAGE

[75] Inventors: Kensuke Endo; Yuji Marukawa, both of Hachioji, Japan

[73] Assignee: Konica Corporation, Japan

[21] Appl. No.: 08/999,301

[22] Filed: Dec. 29, 1997

[30] Foreign Application Priority Data

Jan. 8, 1997 [JP] Japan ..... 9-001223

[51] Int. Cl.[7] ..... G03G 9/08

[52] U.S. Cl. ..... 430/110; 430/111

[58] Field of Search ..... 430/110, 111

[56] References Cited

U.S. PATENT DOCUMENTS

| | | | |
|---|---|---|---|
| 4,623,605 | 11/1986 | Kato et al. | 430/110 |
| 5,604,071 | 2/1997 | Okado et al. | 430/110 |
| 5,747,211 | 5/1998 | Hagl et al. | 430/110 |

FOREIGN PATENT DOCUMENTS

| | | | |
|---|---|---|---|
| 0435608 | 7/1991 | European Pat. Off. | 430/110 |
| 60-136752 | 7/1985 | Japan . | |
| 62-180376 | 8/1987 | Japan . | |
| 1-234859 | 9/1989 | Japan . | |
| 4-44053 | 2/1992 | Japan . | |

*Primary Examiner*—Janis L. Dole

*Attorney, Agent, or Firm*—Jordan B. Bierman; Bieman, Muserlian and Lucas

[57] ABSTRACT

A toner for developing an electro static latent image is disclosed. The toner comprises colored particles and fine titanium oxide particles, in which the transmittance of the fine titanium oxide particles in terms of a UV absorptiometry is 30–60% at 300 nm and 70–100% at 600 nm.

6 Claims, 2 Drawing Sheets

TONER AND DEVELOPERS FOR DEVELOPING STATIC LATENT IMAGE

BACKGROUND OF THE INVENTION

The present invention relates to toners and developers which develop a latent charge image in an electrophotographic method and also for electro-static printing; and an image forming method using the same.

The most common image forming method employing an electro-static charge developing method is composed of a developing step in which an electrostatic latent image is formed on the surface of a photoreceptor and a toner image is formed from the electro-static latent image by means of a dry-type developer composed of fine colored powders, a transfer step in which the above-mentioned toner image is transferred onto a recording sheet, such as paper and then successively, a fixing step in which the toner image is fixed onto the recording sheet due to heating or pressing.

In the developing step, development of the electro-static latent image is conducted for forming the toner image. However, all the toner forming the toner image is not transferred onto the recording paper. Usually, a part of toner remains on the photoreceptor. Heretofore, the remaining toner was collected by means of a cleaning device to be discarded. Recently, however, from the viewpoint of economy and environmental concern, an image forming method employing a so-called toner recycling system in which collected toner is returned to the developing device again by means of a toner conveyance screw and is utilized as toner for developing again has been noticed.

On the other hand, in order to continually form favorable copied images, it is necessary that toner has high fluidity and maintains a stable charge property.

As a technology to improve the fluidity of the toner, it is known to add a fluidity agent such as fine silica particles to the colored particles incorporating at least a coloring agent in the binder resin for mixing.

However, if an image is formed by the above-mentioned image forming method employing a toner recycling system in which toner incorporating a fluidity agent having small particle size, the toner receives excessive physical compression force by means of the toner conveyance screw. As a result, the fluidity agent which should exist on the surface of the toner particles is buried into the toner particles. Therefore, the fluidity of toner is gradually reduced, and together with this, the charge amount of toner is changed so that toner splashing and fogging occur. Further, image density is reduced.

Another factor contributing to the durability of a developer is how to continue to stabilize charge performance of the carrier. Causes of the deterioration of the carrier mainly includes abrasion and peeling of the coated resin and so-called toner spent in which fine toner powders adhere on the surface of carrier for contamination.

Compared with a conventional image forming method, in the case of the image forming method employing the toner recycling system, toner receives stirring stress more frequently. Therefore, it is known that toner fine powder is numerously generated and that carrier deterioration due to the toner spent is further promoted.

In order to solve the above-mentioned problems, technologies to remove toner spent substance by the use of a fluidity agent having large particle size as an abrasion agent are disclosed by, for example, Japanese Patent Publication Open to Public Inspection (hereinafter, referred to as JP Nos. 62-180376 and 1-234859).

As described in aforesaid patent applications, when the particle size of the fluidity agent becomes larger, there is a problem that abrasion scratch due to the fluidity agent occurs on the surface of the photoreceptor, causing stain image due to poor cleaning. Specifically, when an image is formed by means of an image forming method employing an organic photoreceptor (OPC), there is a problem that abrasion scratch easily occurs on the photoreceptor caused by the fluidity agent when the organic photoreceptor is soft. Therefore, there is another technology that by the use of a photoreceptor having a high hardness photosensitive layer such as amorphous silicone, abrasion scratch is reduced. However, there are still unsolved problems in that an amorphous silicone photoreceptor has little charge retention ability and that manufacturing cost of the overall apparatus is increased since the amorphous silicone photoreceptor is expensive.

Due to the above-mentioned problems, the following technologies are disclosed in order to enhance abrasion force by using toner.

(1) A toner by mixing inorganic powder, formed by an burning method, whose BET specific surface according to a nitrogen adsorption method is 0.2–30 $m^2/g$ with nuclei particles (see JP 60-136752).

(2) A toner prepared by mixing inorganic powder whose BET specific surface according to a nitrogen adsorption method is 40–200 $m^2/g$ and whose average particle size is 0.2–2 $\mu m$ with a nuclei particle (see JP 4-44053).

However, according to a toner described in item (1) above, though the average particle size of fine inorganic particles is large, its specific area is small. Therefore, though abrasion effect due to fine inorganic powder is considerable, specific area is so small that abrasion area is accordingly small. Therefore, abrasion force by the fine inorganic powder on the surface of carrier is insufficient.

According to a toner described in item (2), by the use of fine inorganic powders having a large average particle size and a large specific area, improvement in abrasion effect can be attained by utilizing unevenness on the surface of fine inorganic powder. However, since the average particle size of the fine inorganic powders is large, the fine inorganic powder releases from the toner frequently. Therefore, if the above-mentioned fine inorganic powder is used for an image forming method employing an organic photoreceptor specifically, the fine inorganic powder receives excessive pressure at the cleaning section. As a result, released fine inorganic particles damage the photoreceptor.

SUMMARY OF THE INVENTION

An object of the present invention is to provide toner for developing an electrostatic latent and a developer which can provide an excellent image stably without deteriorating the photoreceptor and carrier even in an image forming method employing a toner recycling system by incorporating fine particles having abrasion effect at high level in the toner without causing a scratching problem by means of a cleaning means onto the surface of the photoreceptor.

The present invention and its embodiment will now be described.

Toner for developing electrostatic latent image of the invention comprises colored particles and fine titanium oxide particles wherein the transmittance of the fine titanium oxide particles in terms of a UV absorptiometry is 30–60% at 300 nm and 70–100% at 600 nm.

It is preferable that fine titanium oxide particles are subjected to surface treating with a coupling agent and/or silicone oil. It is also preferable that the primary average particle size thereof is 80–200 nm.

The toner is used with carrier for forming a developer in combination.

The toner can preferably be used in an image forming method which employs the toner recycling system.

The transmittance of the fine titanium oxide particles at 300 nm according to the UV absorptiometry is 30–60%, concurrently with this, transmittance of the fine titanium oxide particles at 600 nm is 70–100%. It is assumed that the fine titanium oxide particles satisfying the conditions have no sharp convex portions, and have a porous unevenness on the surface thereof. It is also assumed that, due to the surface conditions, abrasion effects on the surface of carrier and the surface of photoreceptor are improved and excellent properties in which scratches do not occur on the surface of photoreceptor by means of a cleaning means, such as a blade, are given to the toner.

In addition, the fine titanium oxide particles whose primary average particle size is 80–200 nm are not easily released from the colored particles due to vander Waals force and electro-static adhesion force. In addition, even if the fine titanium particles receives excessive physical compression force in the toner recycling system, the fine titanium particles are difficult to bury in the colored particles. Therefore, it is assumed that change in terms of toner charge amount is difficult to occur and the toner developing can stably provide more excellent images.

EXPLANATION OF SYMBOLS

Figure 1:
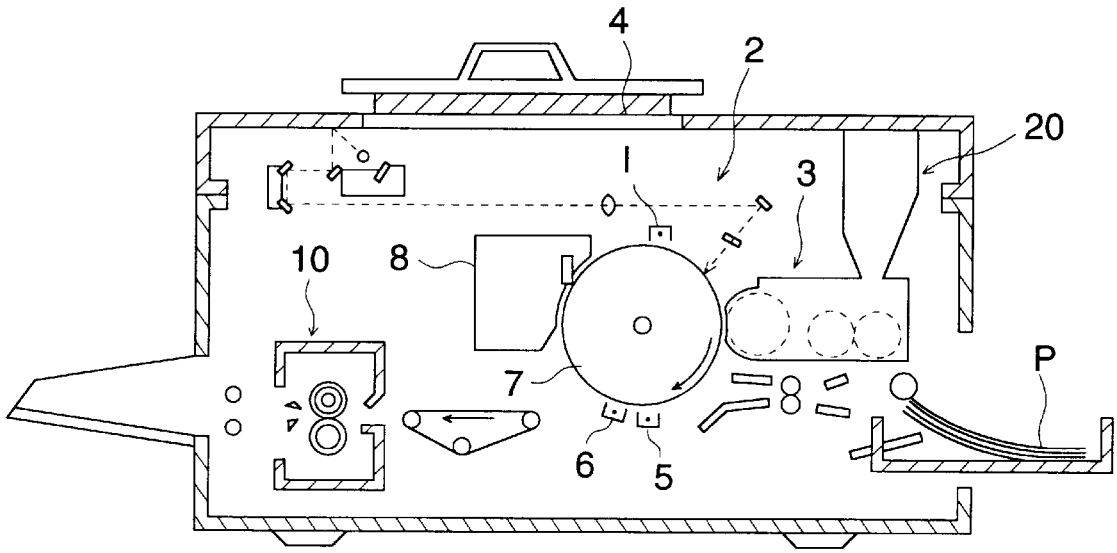
FIG. 1 is a schematic cross sectional view of an image forming apparatus of the present invention.

1. Charger
2. Exposure optical system
3. Developing device
4. Exposure stand
5. Transfer device
6. Separation device
7. Photoreceptor
8. Cleaning device
10. Fixing device
16. Toner conveyance screw 1
17. Toner conveyance screw 2
18. Toner conveyance screw 3

DETAILED DESCRIPTION OF THE INVENTION

The present invention will be explained more practically.

1) Fine Titanium Oxide Particles

It is preferable that fine titanium oxide particles is prepared by means of a wet method. And it is preferably subjected to surface treating.

Transmittance in terms of the UV absorptiometry is measured as follows.

In 250 ml of a 1% aqueous polyoxyethylene (the degree of polymerization: 10) octylphenylether, 25.0 mg of fine titanium oxide particles is dispersed. The resulting mixture is stirred for 5 minutes by means of a magnetic stirrer. Further, the resulting mixture is dispersed for 5 minutes by means of an ultrasonic vibrator. Immediately after that, the resulting mixture is diluted by a factor of 10. Then, by the use of a UV spectrophotometer, the transmittance of the resulting mixture at 300 nm and at 600 nm is measured.

As a spectrophotometer, Model U-3500 manufactured by HITACHI is used for obtaining the results.

The wet preparation method of titanium oxide is a method in which titanium oxide is prepared through a chemical reaction in a solvent. Ordinarily, there are a sulfuric acid method and a hydrochloric acid method. In the case of the sulfuric acid method, due to the following reaction, insoluble titanium oxide hydrate is obtained.

$$FeTiO_3+2H_2SO_4 \rightarrow FeSO_4+TiOSO_4+2H_2O$$

$$TiOSO_4+2H_2O \rightarrow TiO(OH)_2+H_2SO_4$$

In the case of the hydrochloric acid method, titanium tetrachloride is dissolved in water for forming an aqueous hydrochloric acid. Following this, a strong base such as caustic soda is charged in the solution for generating titanium hydroxide by depositing. As the titanium oxide, an anatase type is preferable.

The titanium oxide hydrate or titanium hydroxide is burned at 450–650° C. for crushing to obtain fine titanium oxide particles are obtained by crushing.

Since fine titanium oxide particles prepared by means of the wet method and burned at a relatively low burning temperature, the moisture amount contained therein is relatively large. Therefore, when it is used in an electrophotographic technology, it is preferable for the titanium oxide be subjected to surface treating with a coupling agent or a silicone oil. In this occasion, the degree of hydrophobicity of the surface-treated titanium oxide is 30–80%.

As a surface treating agent, a coupling agent and a silicone oil can be used; including dimethyldichlorosilane, phenyltrimethoxysilane, hexyltrimethoxysilane, octyletrimethoxysilane, hexamethyldisilazane, dimethylsilicone oil, octyl-trichlorosilane, decyl-trichlorosilane, nonyl-trichlorosilane, (4-t-propylphenyl)-trichlorosilane, dipentyl-dichlorosilane, dihexyl-dichlorosilane, dioctyl-dichlorosilane, dinonyl-dichlorosilane, dodecyl-dichlorosilane, didodecyl-dichlorosilane, (4-t-butylphenyl)-octyl-dichlorosilane, dioctyl-dichlorosilane, didesenyl-dichlorosilane, dinonenyl-dichloropentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, amino-denatured silicone oil and phenylmethylsilicone oil.

The purpose of the surface treating of the fine particles is to control hydrophobicity and charging property. A processing agent may be selected according to the purpose. In addition, the treating agent may be used singly or admixture may also be used in combination. Surface treating is conducted by mixing the fine particles with the surface treating agent. Heat may be applied when mixing.

The degree of hydrophobicity of fine titanium oxide particles is evaluated by means of a methanol titration test method.

In the methanol titration method, 0.2 g of fine particles is added to a beaker whose volume is 300 ml containing 50 ml of pure water. While the solution in the beaker is constantly stirred, methanol is titrated from a buret until all amount of the fine particles are caused to be wet. In other words, when all of the fine particles is suspended to the solution, it is defined to be the end point of titration. The degree of hydrophobicity can be represented by a percentage of methanol when titration reaches the end point and methanol of the liquid mixture of high purity water.

The average particle size by number of fine titanium oxide particles is measured according the following procedure. To colored particles, fine titanium oxide particles are mixed to be processed. From those photographed by an electron micrometer, 100 particles are measured by means of image processing using SPICCA produced by Japan Abionics Inc. (Model No. TMN-1528-01) for obtaining the average particle size by number.

The amount of the fine titanium oxide particles in the toner is 0.2–5.0 wt % and preferably 0.2–1.2 wt % compared to the colored particles.

Further, a fluidity agent may be added for improvement of the fluidity of toner.

As a fluidity agent, fine inorganic particles whose primary average particle size by number is 50 nm or less, preferably 5–20 nm are preferable. They may be used independently, or an admixture thereof may be used in combination.

As fine inorganic particles used as a fluidity agent, silica, alumna, titanium oxide, magnesium oxide, zirconium oxide, barium titanate, magnesium titanate, calcium titanate, strontium titanate, zinc oxide, quartz sand, clay, mica, wollastonite, diatomaceous earth, chromium oxide, cerium oxide, Bengala, antimony trioxide, barium sulfate, barium carbonate, calcium carbonate, silicon carbonate, silicon nitride and fatty acid metallic salt are cited. Specifically, silica is preferable.

In order that the fluidity agent provides desired charge property of toner, the surface of the fluidity agent may be processed by a surface treating agent such as a coupling agent and a denatured silicone oil for controlling charge property to be used.

Toner

The toner comprises colored particles composed of a binder resin, and a colorant and additives. As the binder resin, any of several conventional resins used as a binder resin for toner can be used. Practically, styrene based resins, acryl based resins, styrene-acryl copolymer resins, polyester based resins and epoxy based resins are cited.

Styrene-acrylic copolymer resins used as binder resins are resins composed of a copolymer of a styrene monomer and an acryl monomer.

As a styrene monomer, styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene are cited.

As an acryl monomer, an acrylic acid, methyl acrylic acid, ethyl acrylic acid, n-butyl acrylic acid, isobutyl acrylic acid, propyl acrylic acid, n-octyl acrylic acid, dodecyl acrylic acid, lauryl acrylic acid, 2-ethylhexyl acrylic acid, stearyl acrylic acid, 2-chloroethyl acrylic acid, phenyl acrylic acid, α-methyl chloroacrylic acid, methacrylic acid, methyl methacrylic acid, ethyl methacrylic acid, propyl methacrylic acid, n-butyl methacrylic acid, isobutyl methacrylic acid, n-octyl methacrylic acid, dodecylmethacrylic acid, lauryl methacrylic acid, 2-ethylhexyl methacrylic acid, stearyl methacrylic acid, phenyl methacrylic acid, dimethylaminoethyl methacrylic acid, diethylaminoethyl methacrylic acid, acrilo nitrile, methacrylonitrile and acrylamide are cited.

As a colorant, for example, carbon black, nigrosine dye, aniline black, acetylene black, phthalocyanine blue, aniline blue, chalco-oil blue, chrome yellow, ultra marine blue, Du Pont oil red, quinoline yellow, methylene blue chloride, phthalocyanine blue, malachite green oxalate, lamp black, Rose Bengal and their mixture and magnetic substances are cited.

As a fixing property improver or a releasing agent, for example, polyolefines such as polypropylene and polyethylene, paraffin wax, carnauba wax, sazole wax and varnished silicone can be used. These can be used independently or admixture thereof can be used in combination. The fixing improvers are incorporated in the colored particles to be used.

If toner is used in the form of a magnetic toner, magnetic powder is further incorporated in the colored particles. As a magnetic powder, alloy or compounds of iron such as ferrite, magnetite and hematite, zinc, cobalt, nickel and manganese can be used. The average particle size of magnetic powder is preferably 1 μm or less. Specifically, 0.1–0.5 μm is preferable. In addition, the amount of magnetic powder is preferably 20–70 wt % of the total colored particles.

If necessary, a charge controller may be incorporated in toner. As a charge controller, for example, metal complex type compounds, salicylic acid derivatives, Calyxallene compounds, nigrosine compound, quaternary ammonium salt-containing compounds and triphenyl methane containing compounds are cited. The charge controller are incorporated in the colored particles to be used.

Toner is ordinarily prepared as follows. First, the above-mentioned binder resin and a colorant are subjected to kneading and crushing steps for forming colored particles. Following this, additives are added thereto for preparing the toner.

With regard to a magnetic material used for carrier, it is preferable that the average particle size by volume is 10–200 μm and more preferably 20–100 μm and the specific gravity is 3–7. If the average particle size by volume is included within the aforesaid range, carrier adhesion in which carrier adheres onto the photoreceptor when developing. In addition, toner can retain its charge effectively. In addition, poor charging during continuous use rarely occurs. Further, weight of individual carrier is suitable, and toner is not subjected to excessive stress. In addition, functions of additives such as fine titanium oxide particles and silica are not hindered.

If the specific gravity is included in aforesaid range, mixture with toner is suitable. Therefore, a uniform charge of toner is obtained. Weight of one carrier is suitable. Therefore, functions of the above-mentioned additive are not hindered.

The carrier may be laminated with a resin. Resins used for such include silicone resins, styrene-acrylic resins, fluorine-containing resins and olefin resins.

With regard to the preparing method of aforesaid resins, a coating resin is dissolved in a solvent, and the resulting mixture is sprayed in a fluid layer for coating on the core. In addition, fine resin particles may be mechano-chemically coated due to mechanical impact. Further, a method, after resin particles are electro-statically adhered onto nuclei particles, to fuse aforesaid resin particles.

Thickness of the laminated resin is ordinarily 0.05–10 μm, and preferably 0.3–4 μm. It is preferable that the amount of laminated resin is 0.1–5 wt % per carrier core.

Image Forming Method

The above-mentioned toner or the developer containing it can desirably be used in an image forming method employing a toner recycling system. In the toner recycling system, toner receives excessive physical compression force. Therefore, carrier spent speed by means of colored particles fine powder is extremely promoted. However, fine titanium oxide particles of the present invention are difficult to be buried in the colored particles, and exists on the surface of colored particles. Since abrasion removal effect of the carrier spent substance can be maintained due to the titanium oxide itself or due to unevenness on the surface of fine titanium oxide particles, it is assumed that change of toner charge amount is difficult to occur so that excellent images can be maintained.

The toner recycling system is referred to as a system in which untransferred toner remained on the photoreceptor is collected with a cleaning device and the collected toner is returned to a developing device and/or a toner replenishing box for re-use.

FIG. 1 shows one example of a cross sectional view of an image forming apparatus applicable to the image forming method of the present invention. Symbol 7 represents a photoreceptor having a form of a rotating drum, and preferably composed of an organic photoconductive substance (OPC) or metallic photoconductive substance (SeTe and $As_2Se_3$). Specifically, an OPC photoreceptor is preferable from the viewpoint that it can be assembled from various substances and therefore it can meet various performance requirements and it can be disposed of easily.

On the circumference of the photoreceptor, from the upstream side to the downstream side in terms of rotation, charger 1, exposure optical system 2, developing device 3, transfer device 5, separator 6 and cleaning device 8 are located in this order.

In the image forming apparatus, the surface on photoreceptor 7 is charged at uniform potential by means of charger 1. Following this, the photoreceptor is subjected to image-wise exposure by means of exposure optical system 2 so that an electro-static latent image is formed. Using a developer housed in developing device 3, the above-mentioned electro-static latent image is developed so that a toner image is formed. The toner image is electrostatically transferred onto recording paper P by means of transfer device 5. The toner image is heated to be fixed by means of a heated roller fixing device 10 so that a fixed image is formed. On the other hand, as photoreceptor 7 passes transfer device 5, any remaining toner is cleaned off by means of cleaning device 8. Then, the photoreceptor is used in the following image formation. In addition, toner collected by the cleaning device is returned to developing device 3 and/or toner replenishing box 20 by means of the toner recycling system explained later and is subjected to re-using.

Figure 2:
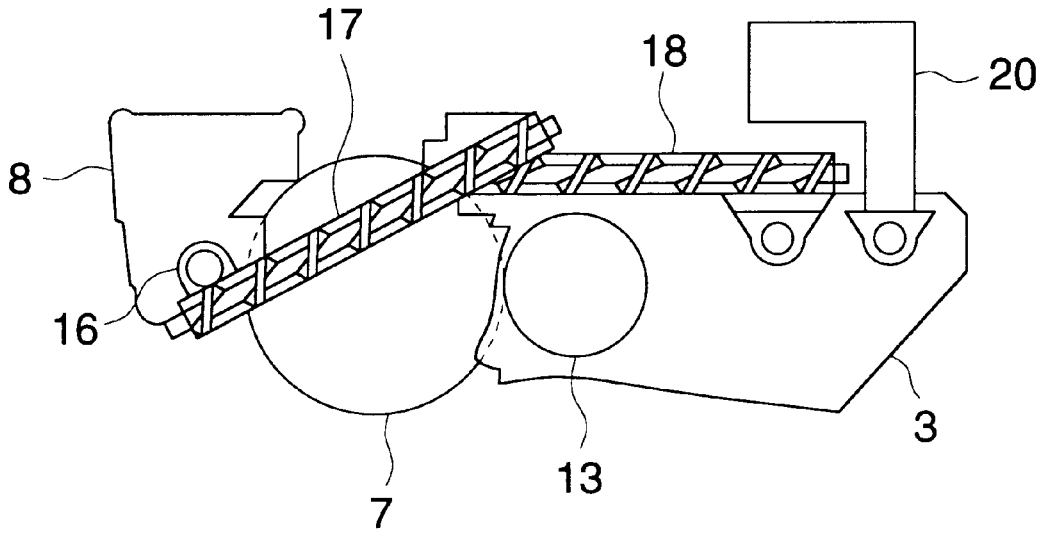
FIG. 2 is a schematic cross sectional view of the toner recycling system of the present invention.
Figure 3:
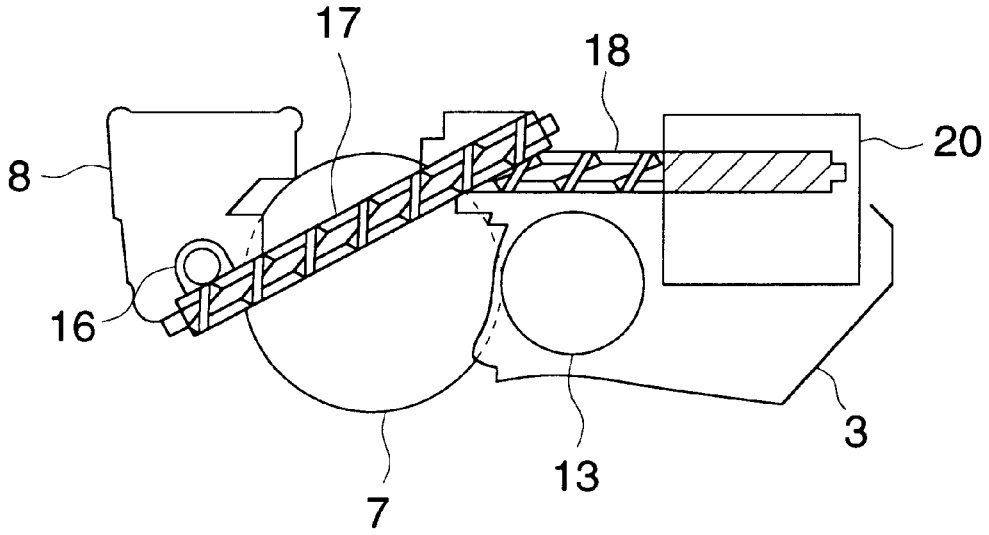
FIG. 3 is another schematic cross sectional view of the toner recycling system of the present invention.

FIGS. 2 and 3 exhibit practical examples of the toner recycling system. In this example, symbol 3 represents a developing device. 13 represents a developing sleeve. 7 represents a photoreceptor. 8 represents a cleaning device. 16 represents a toner conveyance screw 1, 17 represents toner conveyance screw 2, 18 represents toner conveyance screw 3 and 20 represents represents a toner replenishing box. In this apparatus, toner collected at the cleaning section is conveyed by toner conveyance screws 1,2 and 3. The toner is fed to a distributing device (which is different from a feeding port of new toner) exclusively for the collected toner. Namely, symbols 16 (toner conveyance screw 1), 17 (toner conveyance screw 2) and 18 (toner conveyance screw 3) are respectively provided with a rotation shaft therein, and, along with the rotation shaft, are also provided with a spiral-shaped blade. Following the rotation of the rotation shaft, the toner is successively conveyed by the blades, and then is fed to the distributing device. The collected toner is used for forming latent image on the photoreceptor again.

Symbols in each section shown in FIG. 3 represent the same items as in FIG. 2. In the apparatus in FIG. 3, toner collected at the cleaning section is conveyed by means of toner conveyance screws 1, 2 and 3. The toner is the fed to the toner replenishing box. The outstanding feature of the apparatus shown in FIG. 3 compared with FIG. 2 is that, after new toner and the collected recycle toner is stirred for mixing in the toner replenishing box in advance, the resulting toner is fed to the developing device. Symbol 18 (a hatch portion) is inserted in symbol 20.

EXAMPLE

Hereinafter, the present invention will be explained referring to an Example.

1) Preparing of Fine Titanium Oxide Particles

Anatase-type hydrophilic fine titanium oxide particles 1 (the primary average particle size was 100 nm) were added to a toluene solvent in which 60 g of hexyltrimethoxy silane was dissolved, and then, the mixture was subjected to ultrasonic dispersion. Following this, the resulting mixture was subjected to high dispersion processing by means of a medium stirring mill, and then, toluene in the dispersion solution was evaporated to be dried. Next, the resulting substance was crushed with a jet mill so that fine titanium oxide particles A whose surface was processed (the primary average particle size by number was 180 nm) was obtained. By changing the number of jet mill crushing to twice and three times, fine titanium oxide particles B (the primary average particle size was 130 nm) and C (the primary average particle size was 85 nm) was obtained.

In addition, fine titanium oxide particles D (the primary average particle size was 20 nm) in which the jet mill crushing pressure was lowered and crushing strength was weakened was obtained.

Anatase type hydrophilic fine titanium oxide particles 2 (the primary number average particle size was 30 nm) and anatase type hydrophilic fine titanium oxide particles 3 (the primary number average particle size was 200 nm) were similarly subjected to surface treating for crushing for obtaining fine titanium oxide particles E (the primary number average particle size was 50 nm) and fine titanium oxide particles F (the primary number average particle size was 250 nm) were obtained. In addition, fine titanium oxide particles G (the primary number average particle size was 5180 nm) was obtained by means of a preparing method of the above-mentioned fine titanium oxide particles A except dimethyl silicone oil was used in place of hexyltrimethoxy silane.

Table 1 shows the property of each fine titanium oxide particles.

TABLE 1

| Fine titanium oxide particles | Primary number average particle size (nm) | Transmittance 300 (nm) | Transmittance 600 (nm) |
|---|---|---|---|
| A | 180 | 56.1 | 74.5 |
| B | 130 | 40.6 | 80.1 |
| C | 85 | 33.2 | 84.9 |
| D | 200 | 58.4 | 65.5 |
| E | 50 | 22.7 | 91.5 |
| F | 250 | 62.1 | 72.6 |
| G | 180 | 54.2 | 79.8 |

2) Toner Preparing Method

| | | |
|---|---|---|
| Binder resin | Styrene-acrylic resin | 100 parts by weight |
| Coloring agent | Carbon black | 10 parts by weight |
| Parting agent | Polypropylene | 4 parts by weight |

The above-mentioned components were subjected to melting, kneading, crushing and classifying for forming colored particles whose average particle size by volume was 8.5 μm. To the colored particles, silica of 0.8 wt % and the above-mentioned fine titanium oxide particles of 0.6 wt % was mixed to be processed for obtaining toners A through G.

3) Preparing Method of a Developer

As a carrier, carrier laminated with a fluorine-containing acrylic-type resin. To the carrier, the above-mentioned toners were mixed in such a manner that the toner density was 5% so that two-component developers A through G were prepared.

4) Performance Evaluation

For evaluating the performance, KONICA U-BIX 4145 produced by Konica Corporation was modified to operate under normal temperature and normal humidity (20° C., 55% RH) to produce an evaluation machine having a toner recycle mechanism as shown in FIG. 2. Using aforesaid evaluation machine, a practical copying test for 30,000 copies were conducted for evaluating image quality (the occurrence of black spot and whether there exist any black spot whose diameter is 0.3 nm or more) and the conditions of the surface of the photoreceptor.

TABLE 2

| | | Scratches on a photoreceptor | Adherence of isolated substance |
|---|---|---|---|
| Inv. 1 | Developer A | Not occurred | No problem |
| Inv. 2 | Developer B | Not occurred | No problem |
| Inv. 3 | Developer C | Not occurred | No problem |
| Inv. 4 | Developer G | Not occurred | No problem |
| Comp. 1 | Developer D | | No problem |
| Comp. 2 | Developer E | Not occurred | Having a filming substance |
| Comp. 3 | Developer F | | No problem |

When developers A through C and G were used, neither scratch on the photoreceptor nor filming occurred, and favorable image quality was obtained. Developers D and F caused black spots. Developer E caused filming occurred on the surface of the photoreceptor due to the toner resin component and image quality was lowered.

As described above, by incorporating fine titanium oxide particles of the present invention in the toner, even in an image forming method employing the toner recycling system, neither toner nor property of the photoreceptor result in no change and copied image having no image quality reduction can be formed over a long period.

We claim:

1. A toner for developing an electrostatic latent image comprising colored particles comprising a styrene-acryl copolymer binder resin, and fine anatase titanium oxide particles having a primary average particle size of 80 to 200 nm, wherein the transmittance of the fine anatase titanium oxide particles in terms of a UV absorptiometry is 30–60% at 300 nm and 70–100% at 600 nm.

2. The toner of claim 1, wherein the fine titanium oxide particles are subjected to surface treating with a coupling agent or silicone oil.

3. The toner of claim 2, wherein degree of hydrophobicity of the surface-treated titanium oxide is 30–80%.

4. The toner of claim 1, wherein the fine titanium oxide particles are prepared by wet preparation method.

5. The toner of claim 1, wherein the amount of the fine titanium oxide particles in the toner is 0.2–5.0 wt % of the colored particles.

6. The toner of claim 1, wherein the toner further comprises a fluidity agent.

* * * * *